US005511645A

United States Patent [19]

Glueck

[11] Patent Number: 5,511,645

[45] Date of Patent: Apr. 30, 1996

[54] ANTI-STRINGING DEVICE FOR A COIN ACCEPTOR

[75] Inventor: Anton Glueck, Harsefeld, Germany

[73] Assignee: National Rejectors Inc., Buxtehude, Germany

[21] Appl. No.: 254,582

[22] Filed: Jun. 6, 1994

[30] Foreign Application Priority Data

Jun. 7, 1993 [DE] Germany ..... 43 18 858.3

[51] Int. Cl.[6] ..... G07F 1/04

[52] U.S. Cl. ..... 194/203; 194/349

[58] Field of Search ..... 194/203, 349

[56] References Cited

U.S. PATENT DOCUMENTS

| | | | |
|---|---|---|---|
| 771,349 | 10/1904 | Buck | 194/203 |
| 2,932,374 | 4/1960 | Nicolaus | 194/203 |
| 3,998,309 | 12/1976 | Mandas et al. | 194/203 |
| 4,128,157 | 12/1978 | Henville | 194/203 |
| 4,542,817 | 9/1985 | Paulson | 194/203 |
| 4,546,868 | 10/1985 | Gregory | 194/203 |

FOREIGN PATENT DOCUMENTS

| | | | |
|---|---|---|---|
| 54-140600 | 11/1979 | Japan | 194/203 |
| 680399 | 8/1992 | Switzerland | 194/203 |

*Primary Examiner*—F. J. Bartuska

*Attorney, Agent, or Firm*—Senniger, Powers, Leavitt & Roedel

[57] ABSTRACT

A coin acceptor comprises a main plate and a side plate which together define a coin path for allowing the passage of coins therebetween. A slot is positioned between the main plate and the side plate for catching any strings that may be attached to coins. Barbs are provided inside the slot for retaining the strings. The width of the slot is smaller than the thickness of the smallest coin and is so arranged that, when a string attached to a coin is tightened, the string is moved into the slot. An acceptance and a rejection channel are positioned downstream from the coin path. The acceptance channel has an additional slot for catching strings. First and second coin sensors are positioned adjacent the acceptance channel. If the first sensor detects the presence of a coin after the second sensor has already detected the same coin, then it is likely that a string is being used to manipulate the coin acceptor and the generation of a credit signal is disabled.

5 Claims, 4 Drawing Sheets

ANTI-STRINGING DEVICE FOR A COIN ACCEPTOR

BACKGROUND OF THE INVENTION

The present invention relates to a device for inhibiting the use of a coin on a string to defraud a coin acceptor.

Users who wish to defraud a coin acceptor have been known to attach a thin string to a coin and to insert the coin into the coin acceptor. The presence of a genuine coin with the timing of a genuine coin causes the coin sensor checking the coin to judge the coin to be genuine and to move the coin to an acceptance area. An acceptance switch causes genuine coins to move to an acceptance channel for delivery to a coin box and causes all other articles to move to a rejection channel for return to the user. A coin sensor arranged downstream from the acceptance switch generates a credit signal when a coin passes through the acceptance channel toward the coin box. However, when a coin is attached to a string, the coin is not supplied to the coin box but rather the user tries to draw the coin back to the coin slot or a point above the acceptance switch so that the coin can be manipulated into the rejection channel and improperly retrieved.

Another technique for defrauding a coin acceptor is to attach a genuine coin to one end of a string and to attach a counterfeit coin or disk to the other end. The genuine coin is inserted first and, after it has been accepted for credit, the counterfeit coin is inserted. The counterfeit coin is rejected back to the user through the rejection channel. The user tries to manipulate the string attached to the counterfeit coin to improperly retrieve the genuine coin.

Prior designs have addressed this stringing problem. German Application Nos. DE 39 29 729 and DE 41 17 096 and EPO Application No. EP 0 358 946 show a lever or similar mechanism which is moved by a string attached to a coin. The string prevents the lever from returning to its original position. The position of the lever is optically sensed for the purpose of transmitting a signal to a control and evaluation circuit which detects stringing based on the position of the lever.

German Application No. DE 27 33 636 shows a string catching mechanism in a coin acceptor which retains the string and, consequently, the coin to prevent the latter from giving a signal to the credit memory. In practice, it has been found that the elements used to catch and retain the thin and light string must be mechanically sensitive and they may be easily damaged when a force is exerted on the string. Damage to the string catching mechanism may render it inoperable and may even block the coin travel path thus necessitating a service call. The above-described devices for preventing a string manipulation are also relatively sensitive.

German Application No. G 92 00 559.3 shows a heater for a coin acceptor which cuts a string thermoelectrically. The heater is switched on and off in response to a pressure switch in the area of the heating element. This requires additional expense and, in any event, may be circumvented by a clever manipulation.

SUMMARY OF THE INVENTION

Among the objects of the present invention are to provide improved coin acceptors which are reliable, durable and compact; to provide improved coin acceptors which safely and reliably inhibit efforts to cheat them; to provide improved coin acceptors which inhibit stringing; and to provide improved coin acceptors which are inexpensive to manufacture.

Generally, one form of the invention is a coin acceptor for inhibiting a user from using a string attached to a coin to defraud the coin acceptor. The coin acceptor includes a main plate and a coin path attached to the main plate. The coin path and the main plate define a slot therebetween. The coin acceptor also includes a side plate corresponding to the main plate. The slot is narrower than a thinnest coin to be protected against use of the string. The slot opens towards an end of the coin path. The slot is positioned to receive the string after the coin to which the string is attached has passed downstream of the coin path.

Another form of the invention is a coin acceptor for inhibiting a user from using a string attached to a coin to defraud the coin acceptor. The coin acceptor includes a coin acceptance channel for retaining genuine coins within the coin acceptor and a coin rejection channel for ejecting nongenuine coins from the coin acceptor. A wall is positioned between the coin acceptance channel and the coin rejection channel. The wall includes a slot for cetching the string to prevent the coin attached to the string from being retrieved from the coin acceptor through the coin rejection channel.

Other objects and features will be in part apparent and in part pointed out hereinafter.

FIGS. *6a* and *6b* show views of the side plate opposite to the main plate of the coin acceptor in the area of line *6b*—*6b*.

Figure 4:
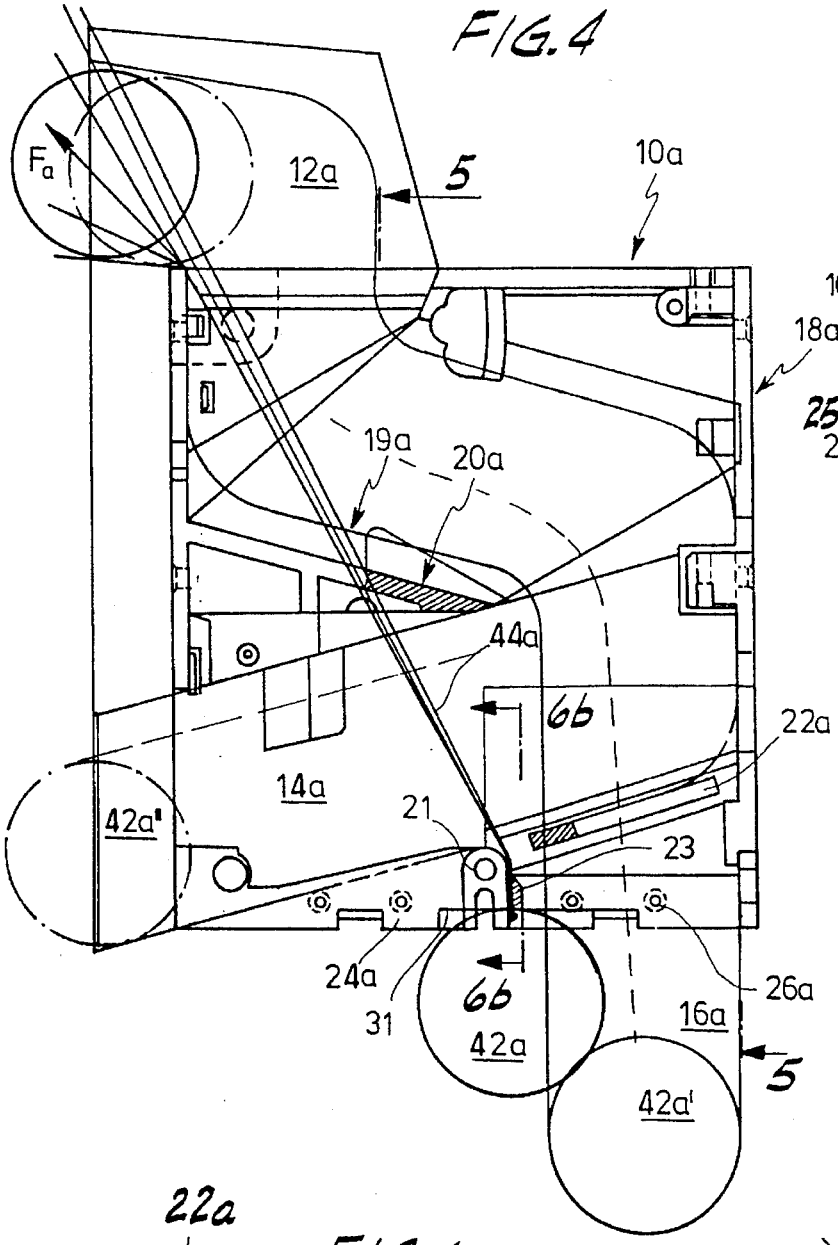
FIG. 4 is similar to FIG. 1 but with modified coin outlets.
Figure 5:
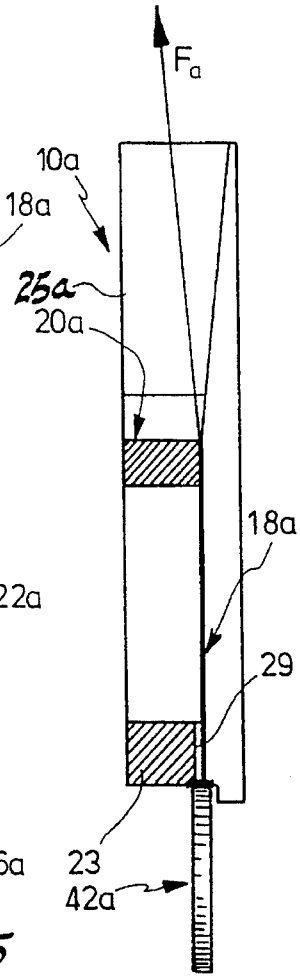
FIG. 5 shows a section through the illustration according to FIG. 4 along line 5—5.
Figure 6A:
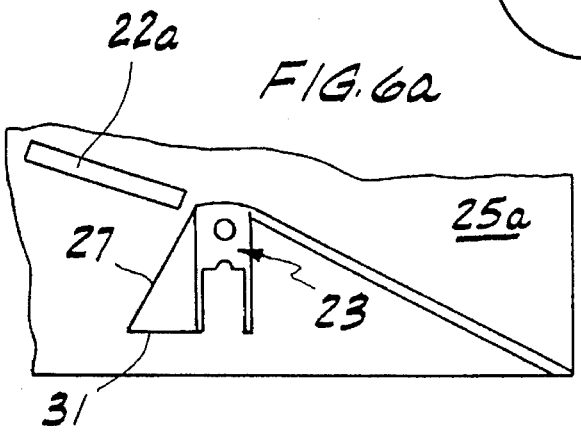
Figure 6B:
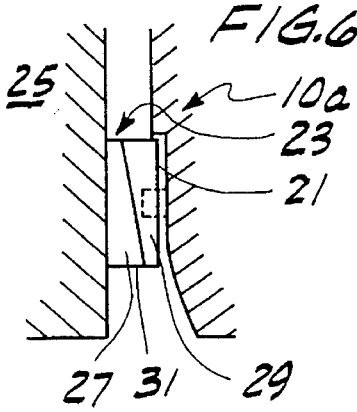
Figure 7:
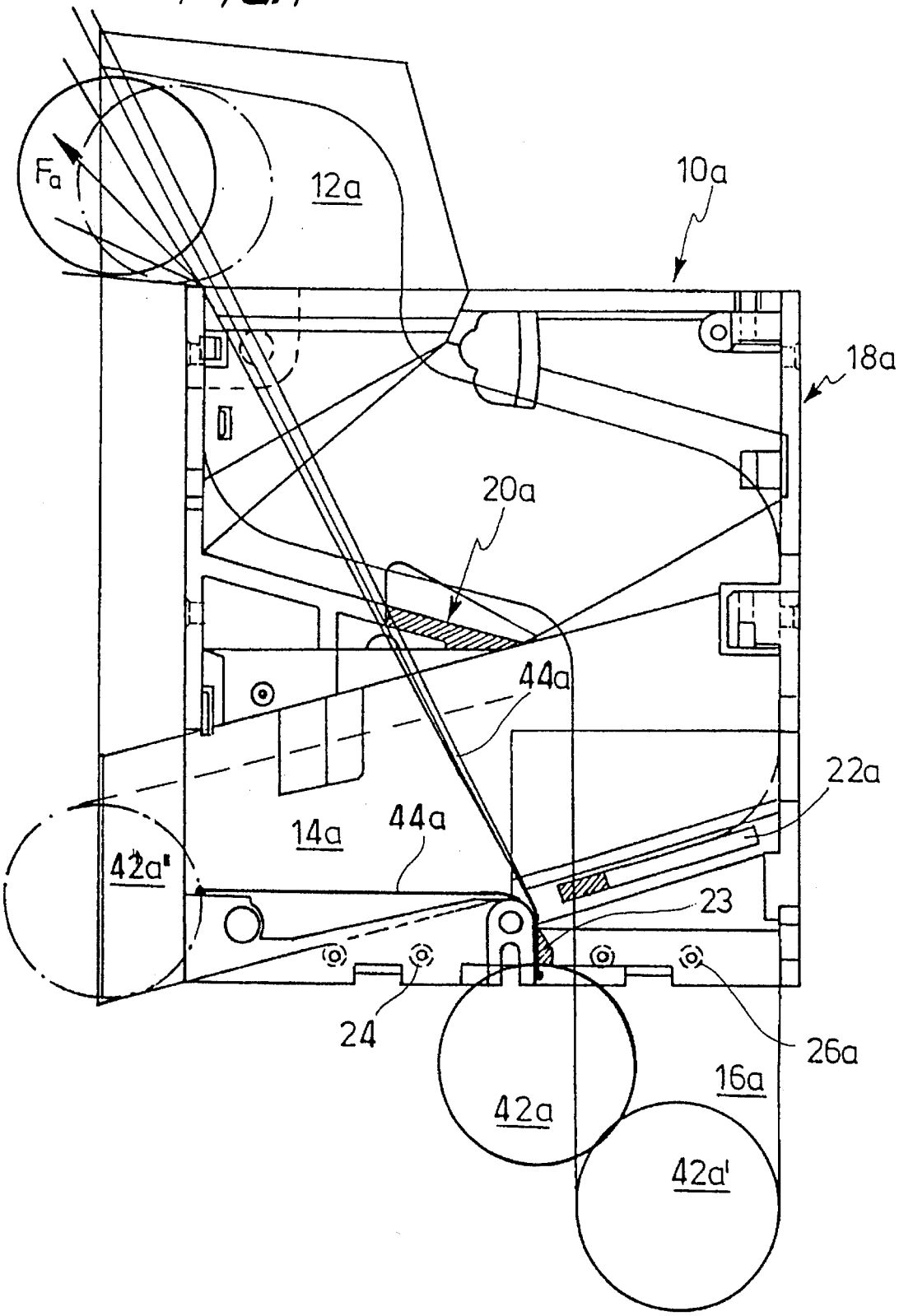

FIG. 7 is similar to FIG. 4 but shows a string having two coins attached. Corresponding reference characters indicate corresponding parts throughout the several views of the drawings.

DETAILED DESCRIPTION OF THE PREFERRED EMBODIMENT

Figure 1:
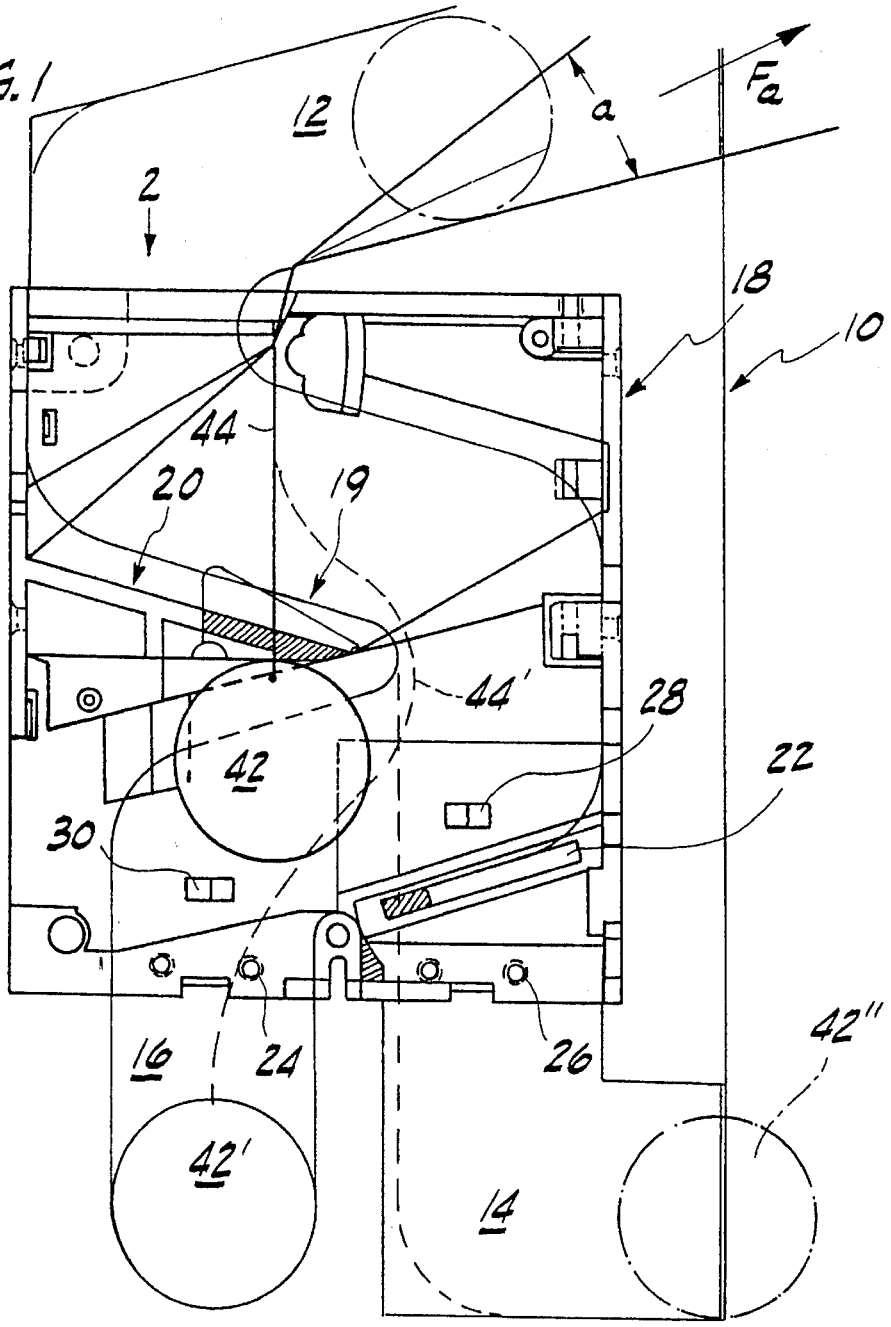
FIG. 1 shows a front view of the main plate of a coin acceptor including a coin on a string.
Figure 2:
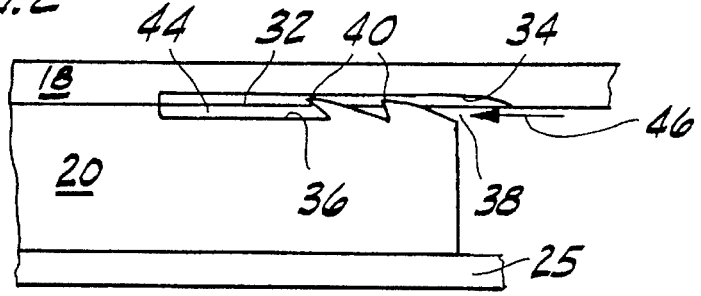
FIG. 2 shows a view of the slot in the coin path of the coin acceptor of FIG. 1 as viewed in the direction of arrow 2.

FIGS. 1 and 2 show a coin acceptor 10 having a coin receiving channel 12 for inserting coins into coin acceptor 10. Coin acceptor 10 includes a main plate 18 and a side plate 25 which together define a coin path for allowing the passage of coins between plates 18 and 25. A ramped coin path 19 is supported from side plate 25 and engages the corresponding wall of main plate 18. Ramped coin path 19 is positioned downstream from coin receiving channel 12. A rejection channel 14 and an acceptance channel 16 which leads to a coin box or safe are positioned downstream from ramped coin path 19. A counterfeit coin path 20 is supported from main plate 18 for guiding coins when side plate 25 is moved away from main plate 18.

Several coin sensors (not shown) are positioned along ramped coin path 19 for checking the genuineness of a dropping coin. A control and evaluating circuit (not shown) receives the output signals of the coin sensors and determines whether or not the passing coin is genuine. The coin then moves to an acceptance switch 22. Acceptance switch 22 is closed when a genuine coin has been detected so that the coin passes over rejection channel 14 and into acceptance channel 16. For all other inserted coins and articles, acceptance switch 22 is opened so that the dropping coin or article moves into rejection channel 14 for return to the user.

Optical presence sensors 24 and 26 are positioned adjacent acceptance channel 16 and rejection channel 14, respectively. After the coin sensors determine that an inserted coin is genuine and after presence sensor 24 detects the coin, a credit signal is generated for providing the corresponding goods or service. Additional presence sensors 28 and 30 are located upstream from acceptance switch 22 and presence sensor 24, respectively.

As shown in FIG. 2, a slot 32 is positioned between main plate 18 and counterfeit coin path 20. Slot 32 includes a recess 34 in main plate 18 and a recess 36 in counterfeit coin path 20. Slot 32 is preferably narrow enough to retain the smallest coin to be protected against stringing. As shown at reference number 38, slot 32 is wider towards the open end of the slot near the end of counterfeit coin path 20. Barbs 40 are provided inside slot 32. Slot 32 is preferably formed from cooperating recesses provided within counterfeit coin path 20 and main plate 18, with barbs 40 positioned along the coin path.

FIG. 1 shows how a coin 42 hangs on a thin string 44. The different directions of pull $F_a$ are demonstrated in FIG. 1 by the angle alpha. When the coin 42 is judged to be genuine, it runs against locked acceptance switch 22 and moves to a position 42' with the run of the string being indicated by a dashed line 44'. Presence sensor 24 generates a credit signal so that the goods can be made available or the service can be rendered at this time. The user who intends to manipulate coin acceptor 10, however, pulls on string 44 to retrieve coin 42. The tension from this pulling causes the coin and string to move from the position along dashed line 44' into the position of coin 42 and string 44 (shown by the solid line). Coin 42 is thereby pulled against the underside of counterfeit coin path 20 because slot 32 is smaller than the thickness of the coin 42. Accordingly, slot 32 is so arranged that, when force is applied to string 44 with the coin having travelled beyond counterfeit coin path 20, string 44 is moved into slot 32 in the direction of an arrow 46. This occurs without difficulty given the dimensions and position of slot 32 described above. Barbs 40 prevent the string from being moved out of slot 32. Slot 32 preferably includes at least one such barb for retaining string 44 in the event the user tries to remove string 44 from slot 32 at the side. This prevents the improper retrieval of the coin back through coin receiving channel 12 by means of such manipulation. It is therefore permissible to generate a credit signal for a coin attached to a string so long as the coin cannot be improperly retrieved from coin acceptor 10.

Accordingly, the coin path through coin acceptor 10 from ramped coin path 19 to a position behind acceptance switch 22 requires the string connected to the coin to follow a more or less sharp curve which causes the string to move to the side when pulled tight. This moving force is used for inserting the string into slot 32. Slot 32 must be wide enough to permit the string to enter without problems; however, slot 32 must not be so wide that a coin can be pulled through.

FIG. 1 also shows the position of a coin 42" in rejection channel 14 for completeness.

Figure 3:
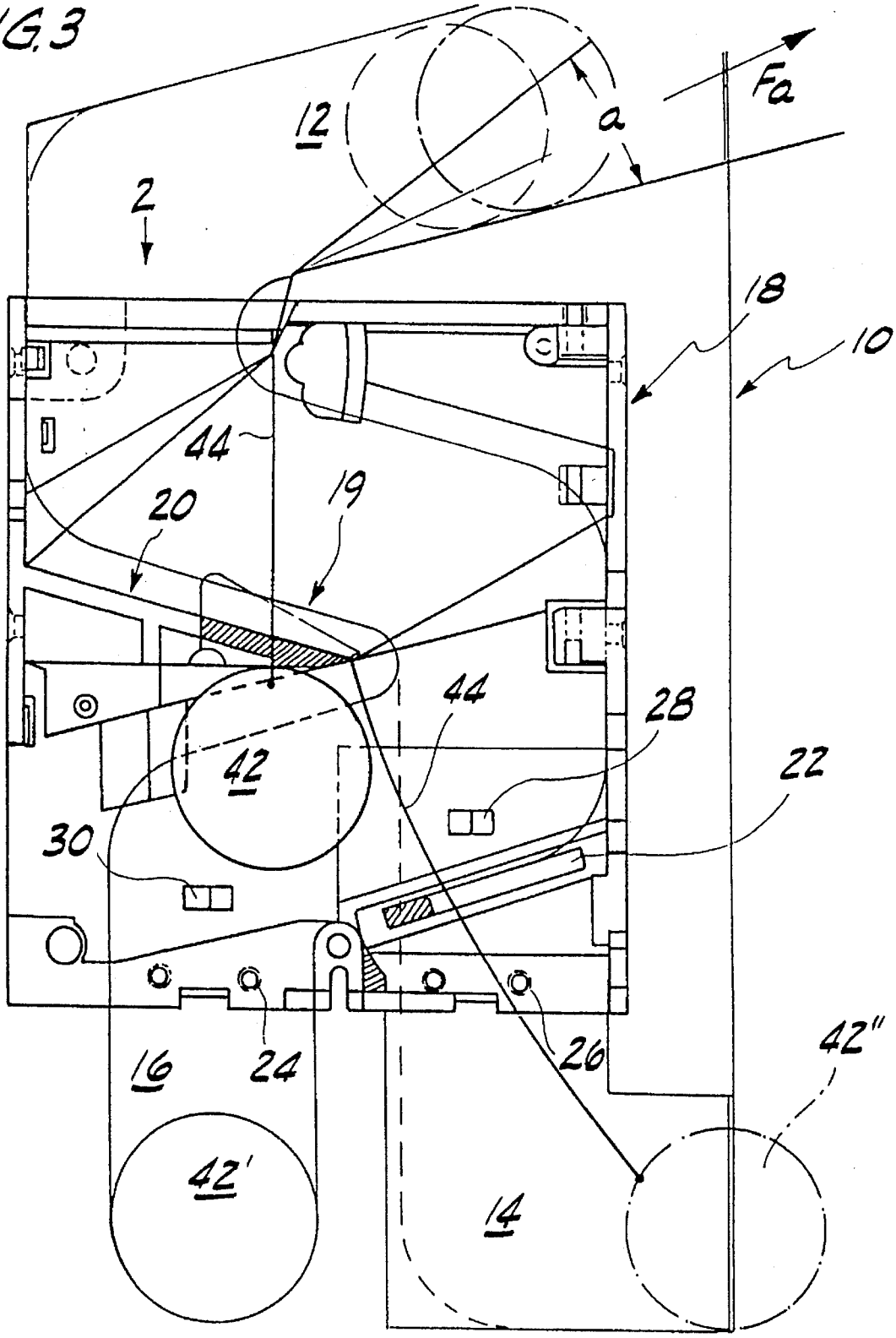
FIG. 3 is similar to FIG. 1 but shows an alternate position for or a coin on a string.

FIG. 3 shows how string 44 may be connected to a coin 42" which coin is intentionally chosen to be unacceptable. Accordingly, coin 42" is moved through the non-actuated acceptance switch 22 into rejection channel 14. The user now manipulates the string to try to move genuine coin 42 positioned at 42' into rejection channel 14 to thereby retrieve coin 42. As shown, however, slot 32 prevents coin 42 from being moved into rejection channel 14.

The presence sensor 30 also provides a safeguard against stringing. If sensor 30 detects the presence of a coin after presence sensor 24 has already detected the same coin, then it is likely that a string is being used to manipulate coin acceptor 10 and the generation of a credit signal is disabled.

FIGS. 4 through **6*b* show a coin acceptor 10*a* having a coin receiving channel 12*a* for inserting coins into coin acceptor 10*a*. Coin acceptor 10*a* includes a main plate 18*a* and a side plate 25*a* which together define a coin path for allowing the passage of coins between plates 18*a* and 25*a*. A ramped coin path 19*a* is supported from side plate 25*a* and engages the corresponding wall of main plate 18*a*. Ramped coin path 19*a* is positioned downstream from coin receiving channel 12*a*. A rejection channel 14*a* and an acceptance channel 16*a* which leads to a coin box or safe are positioned downstream from ramped coin path 19*a*. A counterfeit coin path 20*a* is supported from main plate 18*a* for guiding coins when side plate 25*a* is moved away from main plate 18*a*. As with FIGS. 1 and 2, a slot such as slot 32 is provided between main plate 18*a* and counterfeit coin path 20*a* for preventing a coin 42*a* from being retrieved from coin acceptor 10*a* via a string 44*a***.

Several coin sensors (not shown) are positioned along ramped coin path **19*a* for checking the genuineness of a dropping coin. A control and evaluating circuit (not shown) receives the output signals of the coin sensors and determines whether or not the passing coin is genuine. The coin then moves to an acceptance switch 22*a*. Acceptance switch 22*a* is opened when a genuine coin has been detected so that the coin passes into acceptance channel 16*a*. For all other inserted coins and articles, acceptance switch 22*a* is locked closed so that the dropping coin or article passes over acceptance channel 16*a* and into rejection channel 14*a*** for return to the user.

Optical presence sensors **24*a* and 26*a* are positioned adjacent rejection channel 14*a* and acceptance channel 16*a*, respectively. After the coin sensors determine that an inserted coin is genuine and after presence sensor 26*a*** detects the coin, a credit signal is generated for providing the corresponding goods or service.

FIGS. 4 through **6*b* also show a recess 21 provided in main plate 18*a* which recess engages side plate 25*a* in the lower area. On the side facing acceptance channel 16*a*, a recess 23 comprises a ramp 27 which is not as wide as recess 23. In this way, a slot 29 is defined between the exterior face of ramp 27 and main plate 18*a* which, with the acceptance switch 22*a* being open, prevents coin 42*a* in the above-described manner from being moved upstream past ramp 27 by causing the coin 42*a* to run against an edge 31. Accordingly, acceptance switch 22*a* will not be damaged in a locked position if the manipulator tries to draw coin 42*a* towards switch 22*a*** when it is locked.

As shown in FIG. 7, slot 29 inhibits manipulation of coin acceptor **10*a* using string 44*a* having a genuine coin 42*a* attached to one end and having a counterfeit coin 42*a*" attached to the other end. In particular, slot 29 prevents a user from pulling on the end of string 44*a* attached to counterfeit coin 42*a*" via rejection channel 14*a* to thereby improperly retrieve genuine coin 42*a***.

As shown in FIGS. 4 through 7, slot 29 is preferably located within acceptance channel **16*a* behind acceptance switch 22***a*. This location is especially advantageous where, as in FIG. 4, acceptance channel 16*a* is arranged behind acceptance switch 22*a* in the coin dropping direction and where acceptance switch 22*a* is usually open. This is because acceptance switch 22*a* (which may be locked closed in response to a counterfeit coin on the second end of string 44*a*) will not be damaged if string 44*a* is pulled.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coin acceptor for inhibiting a user from using a string attached to a coin to defraud the coin acceptor, the coin acceptor having a coin entrance slot for receiving inserted coins and having an acceptance and a rejection channel downstream from the coin entrance slot for sorting valid coins from rejected coins, said coin acceptor comprising:

a main plate;

a supporting plate supported for movement relative to the main plate;

a first coin travel path supported by the supporting plate;

wherein the first coin travel path lies between the coin entrance slot and the acceptance and rejection channels and wherein a portion of the first coin travel path is ramped upward toward the coin entrance slot;

a counterfeit coin travel path supported by the main plate, the counterfeit coin travel path being positioned below and running along the first coin travel path for supporting a coin which falls from the first coin travel path in response to the supporting plate being moved relative to the main plate;

wherein the main plate and the counterfeit coin travel path define a slot therebetween which slot is narrower than a thinnest coin to be protected against use of the string and which slot opens towards an end of the coin path;

wherein the slot is positioned to receive the string after the coin to which the string is attached has passed downstream of the first coin travel path;

an acceptance gate positioned in front of the acceptance and the rejection channels;

a first coin presence sensor positioned adjacent to the acceptance gate and downstream from the first coin travel path;

a second coin presence sensor positioned downstream from the first coin presence sensor; and a circuit for generating a credit signal in response to the second coin presence sensor sensing a genuine coin;

wherein the circuit is responsive to said first coin presence sensor to cancel the credit signal if said first coin presence sensor senses the genuine coin after said coin has been sensed by the second coin presence sensor.

2. The coin acceptor of claim 1 wherein the slot comprises a barb for retaining the string in the slot and wherein wherein the barb has an upper surface which is level with the coin path.

3. The coin acceptor of claim 1 wherein the acceptance and the rejection channel are defined in part by a wall, the wall having a second slot therein for receiving the string.

4. The coin acceptor of claim 3 wherein the wall comprises a wedge member for guiding the string into the second slot.

5. A coin acceptor for inhibiting a user from using a string attached to a coin to defraud the coin acceptor, the coin acceptor having a coin entrance slot for receiving inserted coins and having an acceptance and a rejection channel downstream from the coin entrance slot for sorting valid coins from rejected coins, said coin acceptor comprising:

a main plate;

a supporting plate supported for movement relative to the main plate;

a first coin travel path supported by the supporting plate;

wherein the first coin travel path lies between the coin entrance slot and the acceptance and rejection channels and wherein a portion of the first coin travel path is ramped upward toward the coin entrance slot;

a counterfeit coin travel path supported by the main plate, the counterfeit coin travel path being positioned below and running along the first coin travel path for supporting a coin which falls from the first coin travel path in response to the supporting plate being moved relative to the main plate;

wherein the main plate and the counterfeit coin travel path define a slot therebetween which slot is narrower than a thinnest coin to be protected against use of the string and which slot opens towards an end of the coin path;

wherein the slot is positioned to receive the string after the coin to which the string is attached has passed downstream of first the coin travel path.

* * * * *

UNITED STATES PATENT AND TRADEMARK OFFICE

CERTIFICATE OF CORRECTION

PATENT NO. : 5,511,645

DATED : April 30, 1996

INVENTOR(S) : Anton Glueck

It is certified that error appears in the above-indentified patent and that said Letters Patent is hereby corrected as shown below:

Column 6, Claim 2, Line 11: "and wherein wherein" should read ---and wherein---.

Signed and Sealed this

Eighth Day of July, 1997

Bruce Lehman

*Attest:*

BRUCE LEHMAN

*Attesting Officer*

*Commissioner of Patents and Trademarks*